US008636384B2

(12) United States Patent
Battis et al.

(10) Patent No.: US 8,636,384 B2
(45) Date of Patent: Jan. 28, 2014

(54) LASER DAZING PISTOL SHAPED OPTICAL DISTRACTOR AND SEARCHLIGHT

(75) Inventors: Robert Battis, Mercerville, NJ (US); Wayne Armstrong, Placitas, NM (US)

(73) Assignee: Laser Energetics, Inc., Mercerville, NJ (US)

( * ) Notice: Subject to any disclaimer, the term of this patent is extended or adjusted under 35 U.S.C. 154(b) by 0 days.

(21) Appl. No.: 13/375,631

(22) PCT Filed: Jun. 1, 2010

(86) PCT No.: PCT/US2010/036893

§ 371 (c)(1), (2), (4) Date: Dec. 20, 2011

(87) PCT Pub. No.: WO2010/141462

PCT Pub. Date: Dec. 9, 2010

(65) Prior Publication Data

US 2012/0075843 A1 Mar. 29, 2012

Related U.S. Application Data

(60) Provisional application No. 61/182,824, filed on Jun. 1, 2009, provisional application No. 61/182,823, filed on Jun. 1, 2009, provisional application No. 61/218,675, filed on Jun. 19, 2009, provisional application No. 61/218,682, filed on Jun. 19, 2009, provisional application No. 61/237,371, filed on Aug. 27, 2009.

(51) Int. Cl.
*G02B 27/20* (2006.01)

(52) U.S. Cl.
USPC ..... 362/259; 362/110

(58) Field of Classification Search
USPC ..... 362/259, 110–114; 42/115, 117
See application file for complete search history.

(56) References Cited

U.S. PATENT DOCUMENTS

| | | | | |
|---|---|---|---|---|
| 4,195,422 | A | 4/1980 | Budmiger | |
| 4,934,086 | A * | 6/1990 | Houde-Walter | 42/115 |
| 6,190,022 | B1 | 2/2001 | Tocci et al. | |
| 7,584,569 | B2 | 9/2009 | Kallio et al. | |
| 2002/0026741 | A1 | 3/2002 | Aguilar | |
| 2002/0070360 | A1 | 6/2002 | Machi | |
| 2002/0105805 | A1 | 8/2002 | O'meara | |
| 2004/0012962 | A1 | 1/2004 | Wolf | |
| 2007/0039225 | A1 | 2/2007 | Kallio et al. | |

* cited by examiner

*Primary Examiner* — Anne Hines
(74) *Attorney, Agent, or Firm* — Perry M. Fonseca

(57) ABSTRACT

Provided is a laser dazing apparatus shaped as a pistol having an encasement formed by a elongated barrel (114) joined to a handle (117), together forming an encasement. The barrel (114) has a forward end and a rear end, and the handle (117) is connected to the barrel (114) towards the barrel's rear end. The barrel encasement (114) also includes an adapter ring (111) with a focusing fixture (112) for controlling divergence of radiation produced by the device. The apparatus also includes various indicators, a laser generator, a least one battery for electrical power, and a plurality of control circuits controlling the laser generation device, battery, indicators and switches. The apparatus also includes a focus range adjuster (105).

19 Claims, 13 Drawing Sheets

110
112
111
118
110
114
105
105
113
116
119
104
102
106
107
117
200
120
103
SEARCH
LOW BATT
HI TEMP
NIGHT SIGHT
Dazer Laser
DEFENDER
10
25
300
400
600

110
112
111
214
500
104
105
102
213
106
107
130
135
116
119
117
122
120
103
Dazer Laser
DEFENDER
Light Fighting Technologies

DEFENDER-MECHANICAL AND GUARDIAN FUNCTIONAL FLOW DIAGRAM

DEFENDER-EFOCUS FUNCTIONAL FLOW DIAGRAM

LASER DAZING PISTOL SHAPED OPTICAL DISTRACTOR AND SEARCHLIGHT

CROSS REFERENCE TO RELATED APPLICATIONS

This application is related to PCT Application PCT/US2010/36893 filed on Jun. 1, 2010, by Robert Battis, et al. titled "Laser Dazing Pistol Shaped Optical Distractor and Searchlight"; and claims priority from U.S. Provisional Patent Applications No. 61/182,823 filed on Jun. 1, 2009, by Robert Battis, et al. titled "Dazer-Laser Defender," No. 61/218,675 filed on Jun. 19, 2009, by Robert Battis, et al. titled "Dazer-Laser Defender," and No. 61/237,371 filed on Aug. 27, 2009, by Robert Battis, et al. titled "Dazer Laser Mean Beam Improvement." This application is also related to U.S. Provisional Patent Applications No. 61/182,824 filed on Jun. 1, 2009, by Robert Battis, et al. titled "Dazer-Laser Guardian" and No. 61/218,682 filed on Jun. 19, 2009, by Robert Battis, et al. titled "Dazer-Laser Guardian." These applications are incorporated herein by reference in their entirety.

FIELD OF THE INVENTION

This invention generally relates to a laser search and dazing devices, and more particularly to a device for optically distracting or dazing a person.

BACKGROUND OF THE INVENTION

Dazing refers to the temporary, safe and reversible physiological effect that a laser beam of radiation has on a subject person's eyes and brain after the person has received a short dose of laser radiation. Dazing usually results in momentary flash blindness lasting a few seconds, followed by a feeling of disorientation, and may also result in a mild headache and motion sickness, which may last several hours. These dazing effects are completely reversible, even after repeated dazings. There are several useful articles describing the physiological background for the effects of a dazing laser on a subject person. One such online article is entitled "Temporal Resolution" and is available at http://webvision.med.utah.edu/temporal.html. Additional references include: "Flicker an Intermittent Stimulation", Vision and Visual Perception, Graham, C. H., (ed), New York: John Wiley and Sons, Inc., 1965, and "Research into the Dynamic Nature of the Human Fovea: Cortex Systems with Intermittent and Modulated Light, Phase Shift in Brightness and Delay in Color Perception," De Lange, *J Opt Soc Am* 48: 784-789 (1958).

Use of lasers for sighting, searching and dazing is not new, for example, U.S. Pat. No. 7,584,569 to a "Target illuminating assembly having integrated magazine tube and barrel clamp with laser sight," by Kallio, et al., (hereinafter, the '569 patent) describes a laser sighting module for use on the barrel of a weapon, wherein the target illuminator can be a solid-state light emitting device. The '569 patent mentions use of the laser sighting device for dazing, although the device lacks several important features of the present invention.

The laser sighting device of the '569 patent, as well as other conventional laser searching devices, are not easily usable as a dazer device for several reasons. Dazing requires illumination of the subject person's eyes. While a searching device might use a tightly focused laser beam for distance, the fluence or area illuminated would be small, making it difficult to illuminate the subject person's eyes. Yet, use of a divergent laser would dissipate the beam over long distances, thereby mitigating any dazing effect. Thus, there is a need for a laser dazing device which allows for fast toggling between a laser search mode and a laser dazing mode.

Also, the dazing effect of prior dazing lasers is limited by the power of the laser beam used. Use of a more powerful laser beam to increase the dazing effect necessarily increases the "minimum safe range," or distance at which the laser beam is considered safe and its effects reversible. Thus, use of a more complex laser beam delivering enhanced dazing effects with less power and a shorter minimum safe distance is also desirable.

Moreover, prior laser dazing devices provided a fixed focus, which resulted in a fixed range of dazing usefulness. It is thus also desirable to provide for changing the range and focus of a laser dazer device as needed for a particular application.

SUMMARY OF THE INVENTION

An aspect of the present invention provides a pistol-shaped laser dazing apparatus including an elongated barrel encasement connected to a handle encasement towards the barrel's rear end. The barrel encasement further includes an adapter ring at the forward end, and a focusing fixture for controlling divergence of radiation produced by the apparatus, the adapter ring providing a laser aperture and controlling the focusing fixture, as well as a control panel, the control panel with various indicators and switches at the rear end. The barrel and handle encasements together provide an enclosure for a laser generator, battery for electrical power, and control circuits in communication with the laser generator, battery, indicators and switches. The apparatus also includes a trigger communication with the control circuits, and a focus range adjuster. In use, the trigger causes the control circuits to control the laser generator to generate electromagnetic output for searching and/or dazing a subject person.

DETAILED DESCRIPTION

Figures 1, 2, 3:
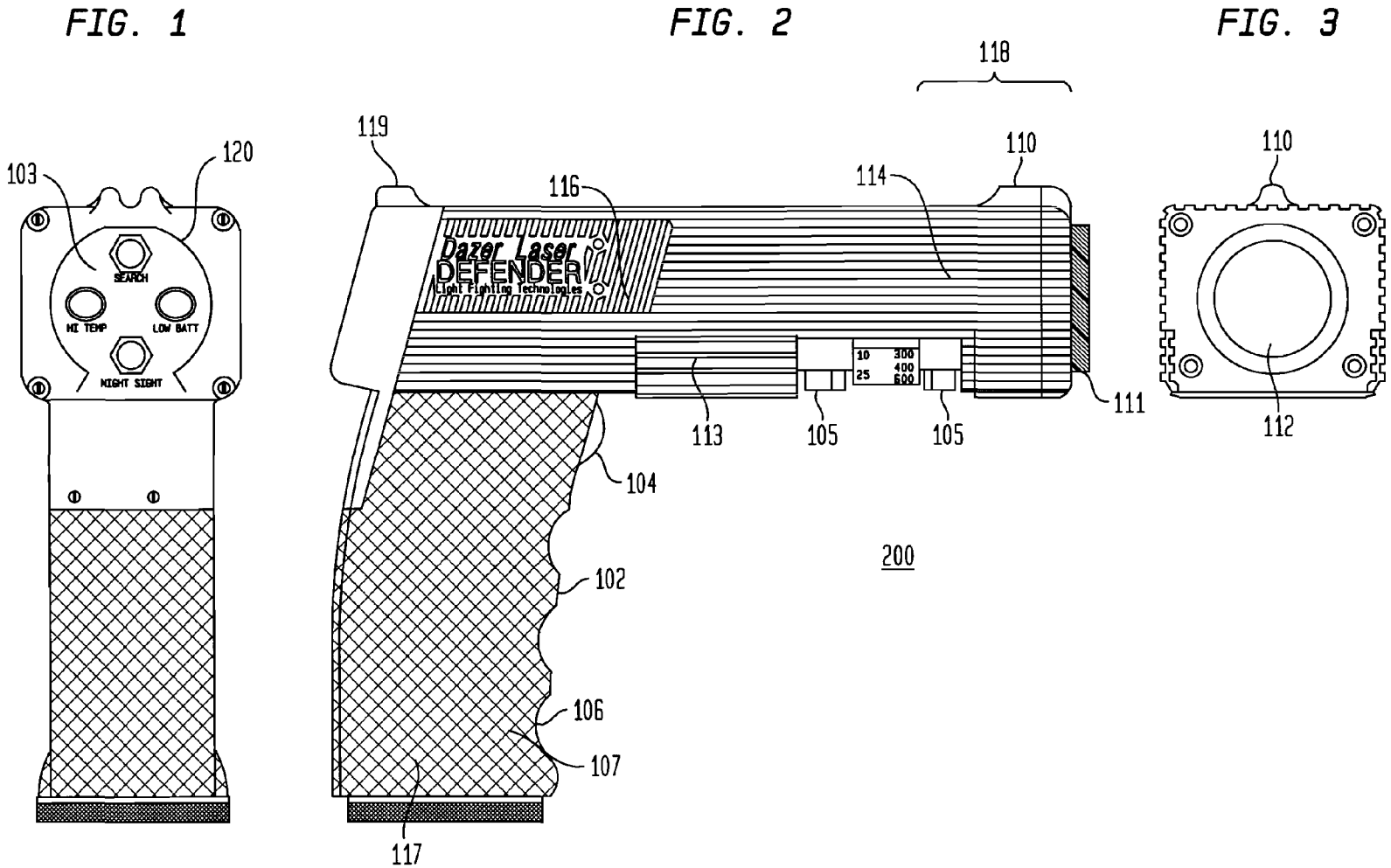
FIG. 1 is a rear view of a pistol shaped laser dazer, in accordance with an embodiment of the present invention.
FIG. 2 is a side view of the laser dazer device of FIG. 1.
FIG. 3 is a front view the laser dazer device of FIG. 1.

In the following description, for purposes of explanation, specific numbers, materials and configurations are set forth in order to provide a thorough understanding of the invention. It will be apparent, however, to one having ordinary skill in the art, that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in an embodiment" in various places in the specification are not necessarily all referring to the same embodiment.

An embodiment of the present invention advantageously provides for a laser dazing device which allows for fast toggling between a laser search mode and a laser dazing mode.

An embodiment of the present invention also provides for use of a complex laser beam delivering enhanced dazing effects with less power and a shorter minimum safe distance is also desirable.

Another advantageous aspect of the present invention is allowing for changing the range and focus of a laser dazer device as needed for a particular application.

FIGS. 1, 2, 3, 4, 5, 6, 7 and 8 depict a external views of exemplary dual mode pistol shaped dazer laser apparatus 200, 500, 700 (hereinafter collectively considered "dazer laser apparatus," or simply "apparatus"). In exemplary embodiments of the present invention, the apparatus includes a barrel encasement portion 114 and a handle encasement portion 117. The barrel encasement portion 114 further includes an adapter ring 111 at the forward end 118, and a focusing fixture for controlling divergence of radiation produced by the apparatus 100. The adapter ring 111 encircles a laser aperture 112. Focusing control is provided by focusing fixture 105. Also depicted are rear and forward sighting protrusions 110, 119, respectively.

Figure 18:
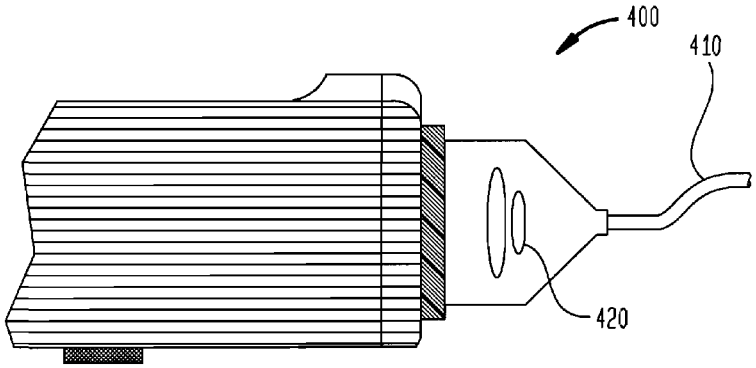
FIG. 18 depicts a fiber optic adapter, in accordance with an embodiment of the present invention; and, FIG. 19 depicts a wand diffuser adapter, in accordance with an embodiment of the present invention.
Figure 19:
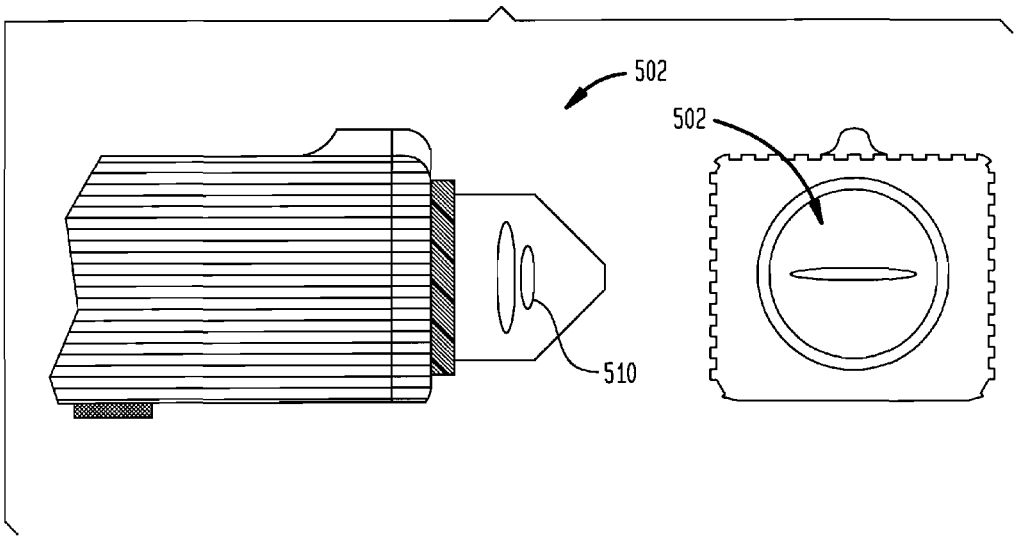

In various embodiments of the invention, adapter ring 111 may be used to attach several accessories, including: as depicted in FIG. 18, a fiber adapter 400 for coupling fiber optics 420 and fiber 410 optic coupler which is used to project the dazing beam, allowing the user to daze around obstacles and under doors; and, as depicted in FIG. 19, a wand-diffuser 502, having wand optics, used to convert the focused beam to a broad asymmetrical beam which disperses the laser energy in a high aspect ratio elliptical shape. The wand-diffuser 502 may use a form of holographic plate or light reflecting facets.

Figures 4, 5, 6:
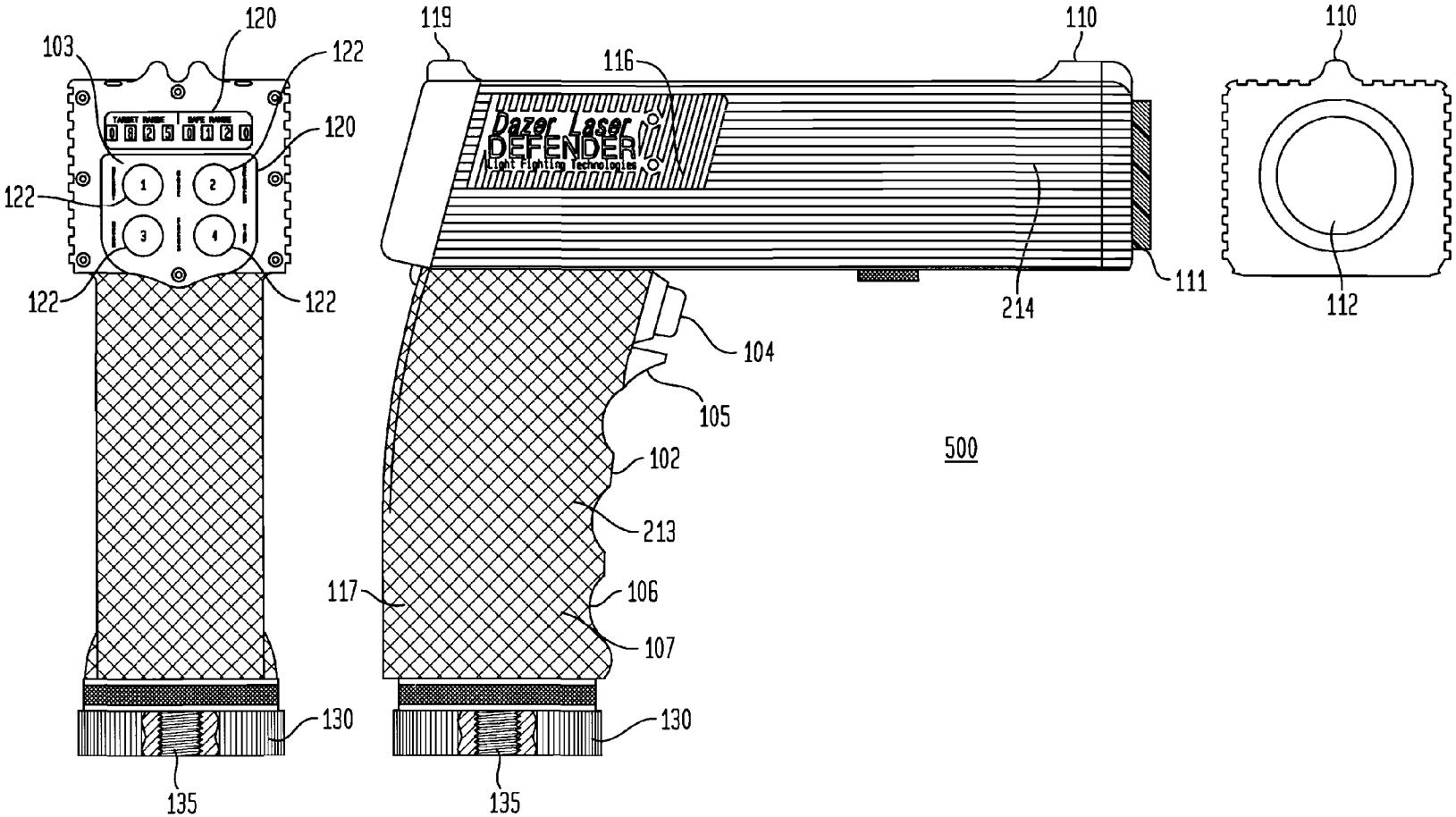
FIG. 4 is a rear view of another pistol shaped laser dazer, in accordance with an embodiment of the present invention.
FIG. 5 is a side view of the laser dazer device of FIG. 4.
FIG. 6 is a front view of the laser dazer device of FIG. 4.
Figure 8:
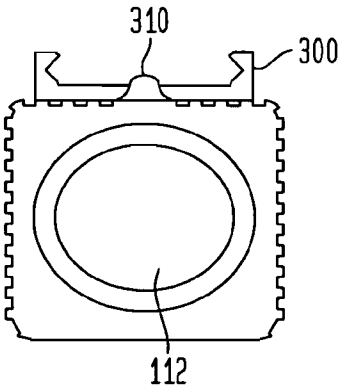
FIG. 8 is a front view of the laser dazer device of FIG. 7.

The apparatus also includes a control panel 120 having various indicators and switches, an exemplary sampling of provided indicators and switches is provided in FIGS. 1 and 4. The indicators and switches provided on the control panel 120 varies in different embodiments of the invention, and may also be customized for a particular user. Various indicators and switches are described in greater detail herein.

Numeric buttons 122, such as depicted in FIG. 4, are also provided in a preferred embodiment of the present invention to enable arming or enabling use of the apparatus by entry of a security code sequence after a security code timeout. Although four numeric buttons 122 are depicted in FIG. 4, it is understood that any number of numeric buttons 122 greater than one may be used, depending on efficacy and ergonomic considerations, without deviating from the inventive spirit of the invention. This feature is also described in further detail herein below.

The barrel encasement portion 114 also includes one or more focus range adjuster 105, 113, which allows control of the variable range and focus features of a preferred embodiment of the invention, as described in additional detail herein.

The barrel encasement portion 114 and handle encasement portion 117 together provide an enclosure for a laser generator, a least one battery for electrical power, and control circuits, also called the "micro-control unit," or "MCU," and electronics for controlling, energizing, and monitoring these and other components as needed. In an embodiment of the invention, the enclosure is water-tight.

Figure 7:
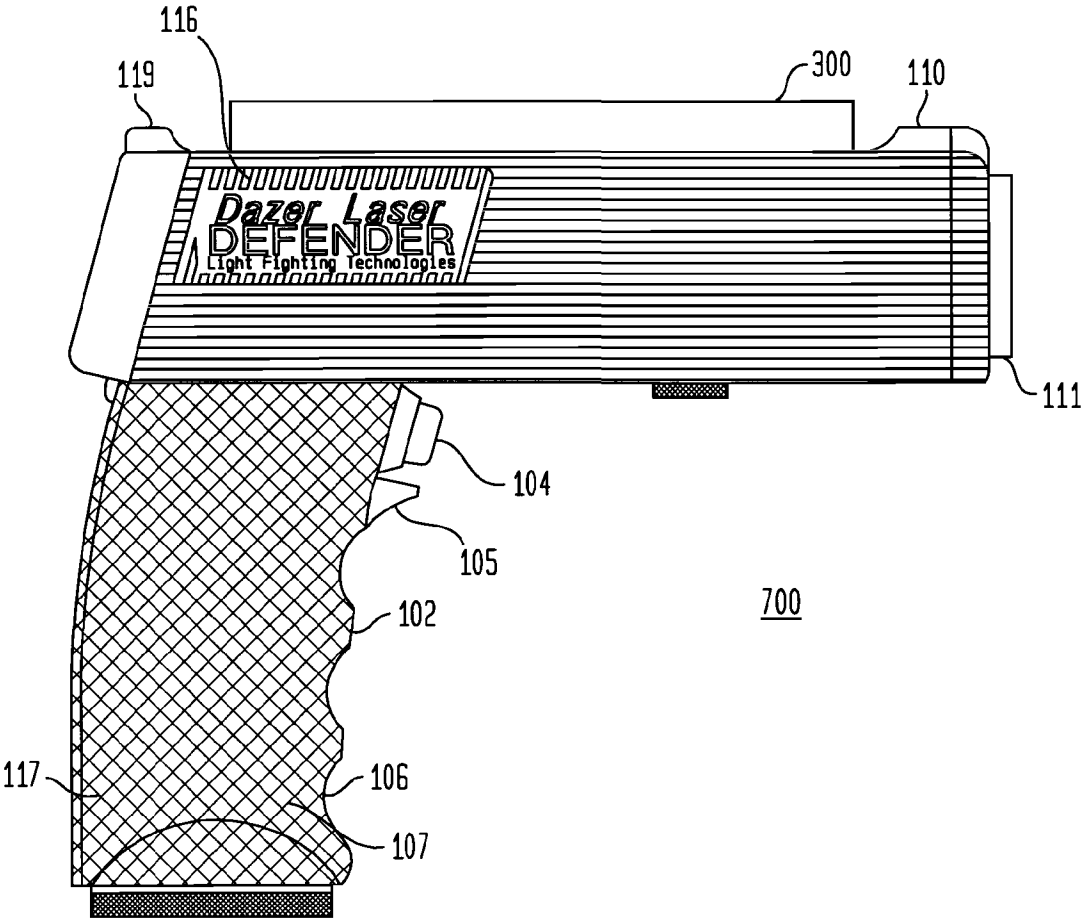
FIG. 7 is a side view of a pistol shaped laser dazer, in accordance with an embodiment of the present invention.

The apparatus also includes a trigger, which is provided as button 104 in an embodiment of the invention. Button 104 is connected to the control circuits. A button guard 105, such as depicted in FIGS. 5 and 7, may also be provided to assist in preventing accidental discharge of the apparatus. Another safety feature optionally included is multiple trigger presses to engage the dazing mode. Button 104 is depicted in FIGS. 2, 5 and 7 as mounted on handle encasement portion 117, although is also envisioned for button 104 to be provided mounted on the barrel encasement portion 114 and/or to be replaced by another conventional trigger device (not depicted).

Handle encasement portion 117 is also preferably coated, encased or formed from a material providing a sure gripping surface 107. Finger indents 106 and spacers 102 are provided to improve the user's ability to securely grip the apparatus. In an embodiment of the invention, the handle encasement portion 117 also includes a battery cap 130, which can be opened to access the apparatus' power supply.

Also in an embodiment of the invention, the handle encasement portion includes a threaded mounting connector 135 for mounting the apparatus to a stabilization device, such as a conventional tripod assembly.

In one embodiment of the invention, a Picatinny rail adapter 300 is provided which fits on the top of the barrel encasement portion 114 and allows the apparatus to be attached to any weapon or device having a Picatinny rail.

Figure 10:
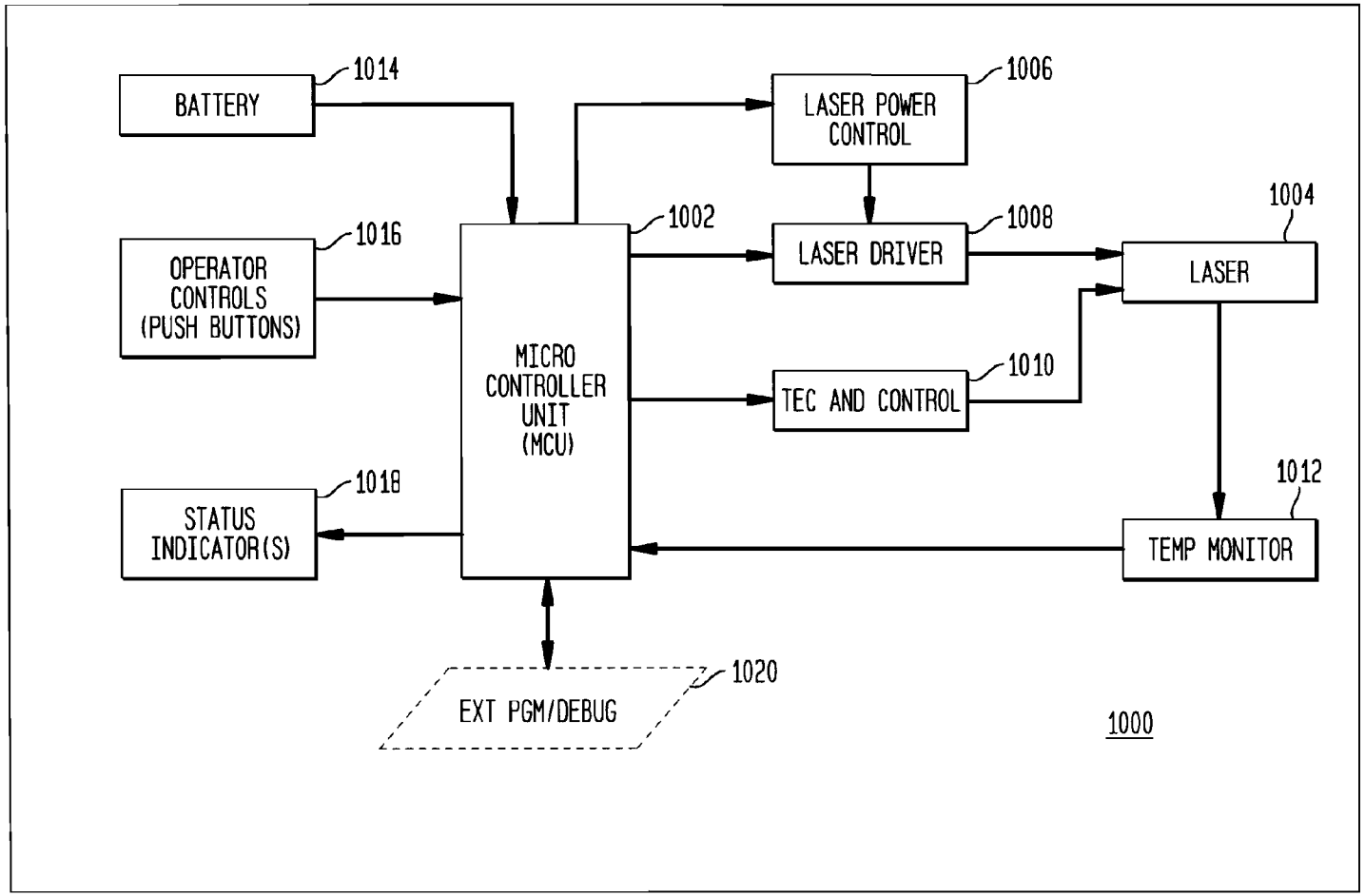
FIG. 10 is a schematic functional flow diagram for a laser dazer, in accordance with an embodiment of the present invention.

FIG. 10 is a schematic diagram depicting the components of an embodiment of the invention. A micro-controller unit 1002 (hereinafter, "MCU") provides for the logical operation of the various components of the apparatus. MCU 1002 is a microprocessor together with its associated volatile and non-volatile computer memory (not depicted), that contains the operational program for the apparatus and controls all aspects of the apparatus' operation. The MCU 1002 outputs directly control the laser 1004 by controlling the laser power control circuit 1006, laser driver 1008 and thermo electric cooler (hereinafter, "TEC") and control 1010. In a preferred embodiment, the MCU 1002 is the PIC18F4520 from Microchip. Those of ordinary skill in computer electronics will understand that the preferred MCU 1002 can be substituted with any suitable processing device or even with multiple processing devices without deviating from the spirit and scope of the invention.

The MCU 1002 also is able to communicate bidirectionally with an external programming and debug apparatus 1020. This apparatus is used to reprogram the MCU 1002, and also to enable monitoring of the MCU 1002 for various purposes, such as for debugging and similar purposes. In normal usage, the external programming and debug apparatus 1020 are not connected to the MCU 1002.

The MCU 1002 also monitors laser 1004 temperature via a temperature monitor 1012. In a preferred embodiment of the invention, a thermistor is used as the temperature monitor 1012. The thermistor forwards a signal to the MCU 1002 that is calibrated in terms of degrees centigrade.

The laser 1004 is a source of radiation of approximately 532 nm, such as a laser diode, and may be of custom design or may be any commercially available 532 nm, 125 mW-500 mW laser. The laser 1004 may be used with reduced range, reduced fluence pattern size, or reduced dazing intensity or any combination of these parameters.

Embodiments of the invention may use any of a variety of lasers depending on the wavelength spectrum of laser desired. In the visible range, the preferred laser is a 808 nm laser diode pumping a ND:YVO4 and KTP crystal combination to produce 532 nm radiation. Other crystal combinations may also be used in the visible band and other wavelength bands may be used, including but not limited to IR and ultraviolet.

The TEC 1010 provides cooling to the laser diode in order to control the laser's 1004 peak temperature. The MCU 1004 controls the TEC 1010 through a power control circuit in a feedback loop using the signal from the temperature monitor 1012. The TEC 1010 is an optional feature of certain embodiments of the invention and is not mandatory.

The MCU 1002 monitors laser temperature and provides TEC, when TEC is included in the instant embodiment of the invention, control, and a fail safe function for the laser 1004 to prevent the laser failing under thermal stress. The MCU 1002 is powered by the battery 1014. The MCU 1002 also takes input from operator controls and push buttons 1016, and outputs to status indicators 1018. The status indicators may take the form of individual LEDs or may be incorporated into an alpha-numeric or graphic display.

Battery 1014 provides power to the MCU 1002 as well as to all the other electrical components. Connection of various components with the battery 1014 has been left off the schematic diagrams for clarity.

Laser power control 1006 implements a portion of the MEAN Beam characteristic, described in detail below, by controlling the depth of modulation and peak power levels for the apparatus' dazing and search modes. The laser power control 1006 is implemented essentially as a digital to analog converter, outputting a complex Mean Beam analog voltage signal to the laser driver 1008.

The laser driver 1008 is a current driver that drives the laser 1004 by controlling the amount of current delivered to the laser diode portion of the laser 1004. The laser driver 1008 includes a circuit that converts the complex Mean Beam input analog voltage signal from the laser power control 1006 to an output proportional current. In addition, the laser driver 1008 controls the temporal characteristic of the laser current, e.g., MEAN Beam pulse width modulation, etc., through the digital input signal from the MCU 1002. In a preferred embodiment of the invention, the laser driver 1008 is implemented using the ATLS4A401-D hybrid from Analog Technologies.

The operator controls and push buttons 1016 are available for the user to input the security code, control day and night functionality of the MEAN Beam and force the apparatus into either search or dazing mode—the "dual mode" aspect of the invention. Focus control of the variable range and focus subsystem, which changes divergence of the laser beam in order to focus the beam in a different range as described below, is accomplished by turning a mechanical lever in one embodiment of the design. In another preferred embodiment, focus is controlled by push buttons on the control panel which communicate with the MCU and in turn control a motorized translation stage with position feedback.

As previously described, the status indicators 1018 may be customized to suite the user, and generally provides feedback to the user on the status of the apparatus. Available status indicators include information regarding the battery, temperature, security mode, focus range, safe range and MEAN Beam night/day setup. A mechanical position reading is optionally provided for target range—the range at which the laser radiation pattern or circle is 1 meter in diameter—and the ANSI safe range—the minimum range for which the laser fluence does not exceed the ANSI fluence level, which means ranges greater than this minimum are completely eye safe for repeated exposures according to the ANSI standard for the safe use of lasers.

Figure 9:
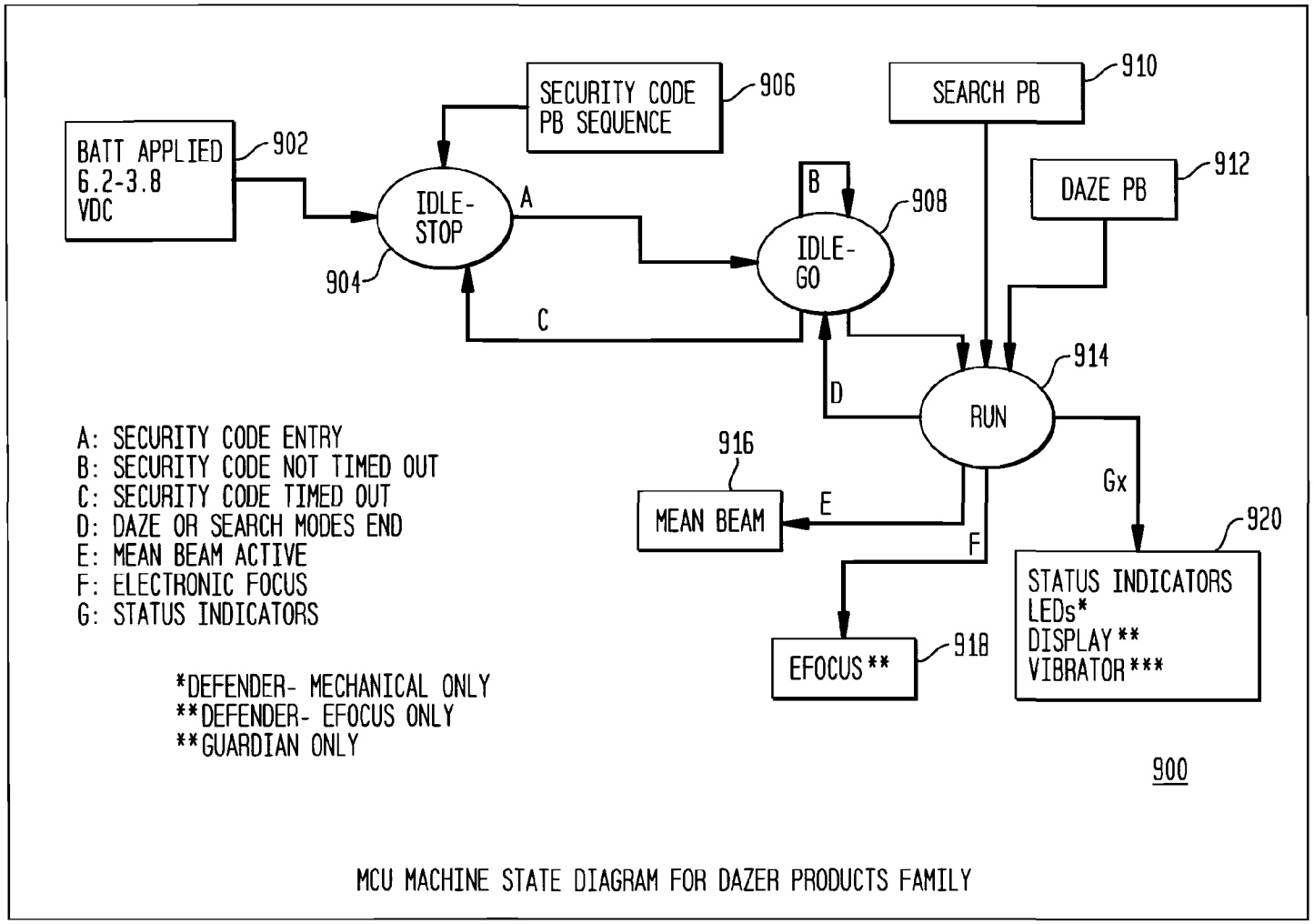
FIG. 9 is a machine state diagram for a laser dazer, in accordance with an embodiment of the present invention.

FIG. 9 is a machine state diagram 900 for an MCU 1002 in operation of the present invention. Control of the dazing laser apparatus is provided by the MCU 1002. Upon energy source 902 activation, the MCU 1002 goes through an automatic power on reset sequence (not depicted), and enters an Idle-Stop machine state 904. The Idle-Stop machine state 904 is a low frequency, low drain current sleep state. The MCU 1002 remains in this state with all device functions inhibited until a proper security code is entered.

When the user enters a security code 906, the MCU 1002 checks the entered code against the pre-set correct code. In a preferred embodiment of the invention, the user enters a security code using numeric buttons 122. Also, the pre-set security code is preferably installed in non-volatile memory at the factory. User re-configuration of the security code, and possible use of persistent memory to store the security code are also provided in embodiments of the invention. Other security code implementations are also possible such as, but not limited to a finger print reader, micro bar code, magnetic reader, and by an electronic coded signal using an RF link.

If the entered security code matches the correct code, the MCU 1002 enters a low current drain Idle-Go machine state 908 and provides feedback to the user that the code has been accepted. If the entered security code is rejected, i.e., if it is incorrect, the MCU 1002 returns to the Idle-Stop machine state 904. This security code feature may be expanded to include a lock-out feature after a preset number of inputting incorrect security codes.

While the MCU 1002 is in the Idle-Go machine state 908, all other device functions are enabled and available to the user instantly, with the appropriate push button command. In a preferred embodiment of the invention, current drain in the Idle-Go machine state 908 has been reduced to allow the apparatus to function in this state for approximately ½ year, although improvements in battery capacity and/or reductions in current drain will prolong this amount of time.

Also, while in the Idle-Go machine state 908, a timer begins counting down a security time-out period. The security time-out period is the amount of time the MCU 1002 will remain in the Idle-Go machine state 908 without use before it returns to the Idle-Stop machine state 904 to once again await entry of the security code. The security time-out period is pre-set to a certain time period, for example 24 hours. In one embodiment of the invention, the security time-out period is fixed. In another embodiment, it may be reset by the user. When the security code time-out period is reached and a valid security code has not been re-entered, the MCU 1002 returns to the Idle-Stop machine state 904, which inhibits all functions except re-entry of the security code.

With the MCU 1002 in the Idle-Go machine state 908, the user can select either Dazing mode 912 or Search mode 910. When Dazing mode 912 or Search mode 910 is selected, the MCU 1002 changes from the Idle-Go machine state 908 to the Run machine state 914. Also, the MEAN Beam 916 and EFocus 918 control mechanisms, as well as various status indicators 920 are then activated.

Figure 11:
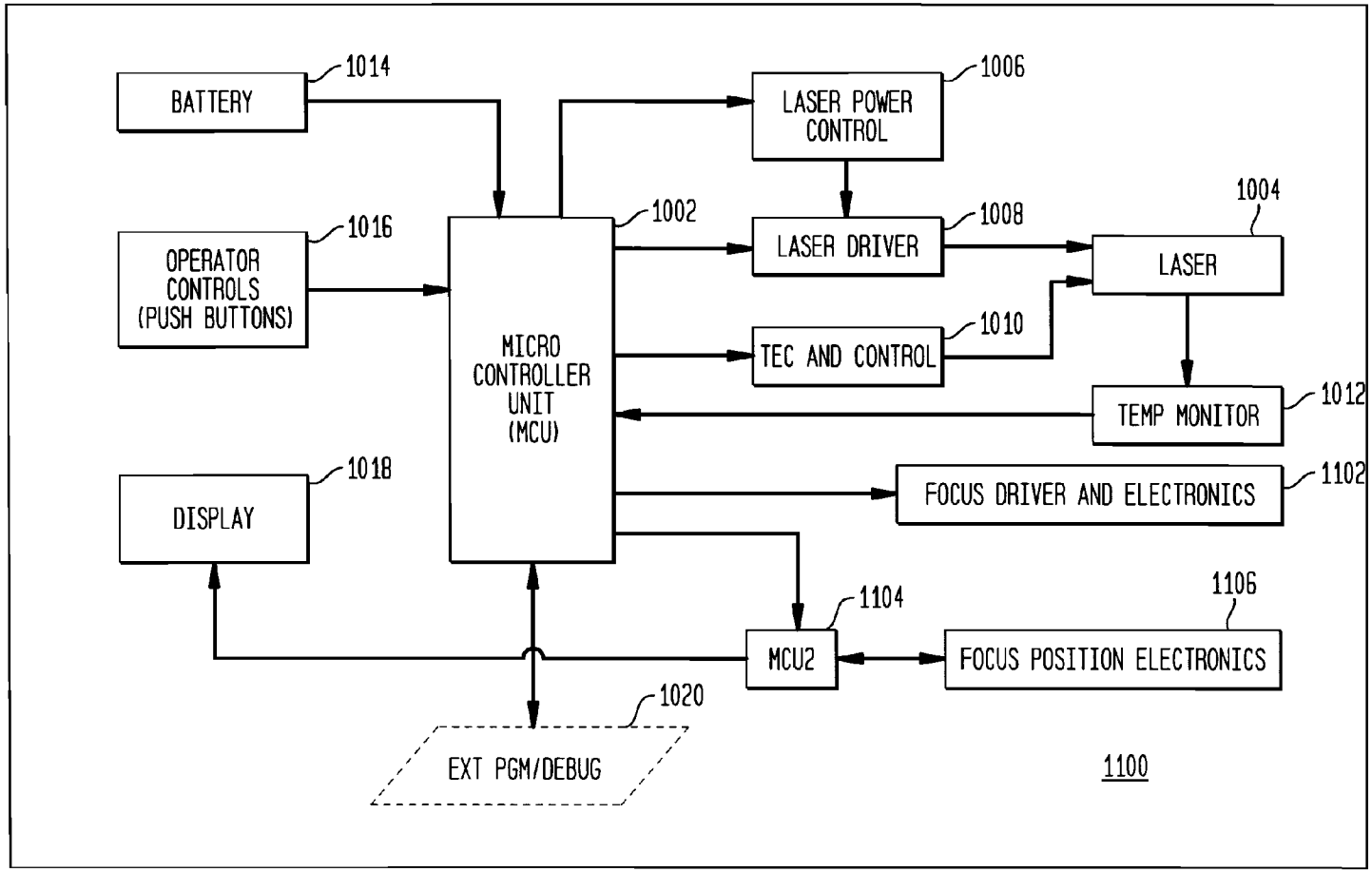
FIG. 11 is a schematic functional flow diagram for variable range and focus in a laser dazer, in accordance with an embodiment of the present invention.

FIG. 11 is a schematic functional diagram 1100 for the EFocus feature of a preferred embodiment of the invention. The EFocus feature is a term used as shorthand for variable range and focus, which represents a means of dramatically improving the performance of optical dazers or distractors. This feature permits the laser fluence to be both tailored and maximized at any target range. Variable range and focus maximizes dazing effectiveness over a larger device operating range compared to fixed focus optical laser dazer. Other benefits from the present invention's use of variable range and focus include modified engagement tactics and reducing or eliminating collateral warning and dazing, or to enable a wider area of dazing, for example in crowd control.

In order to understand the benefits of a variable range and focus system as it pertains to laser dazing apparatus, a conventional fixed focus system is described first.

Figure 14:
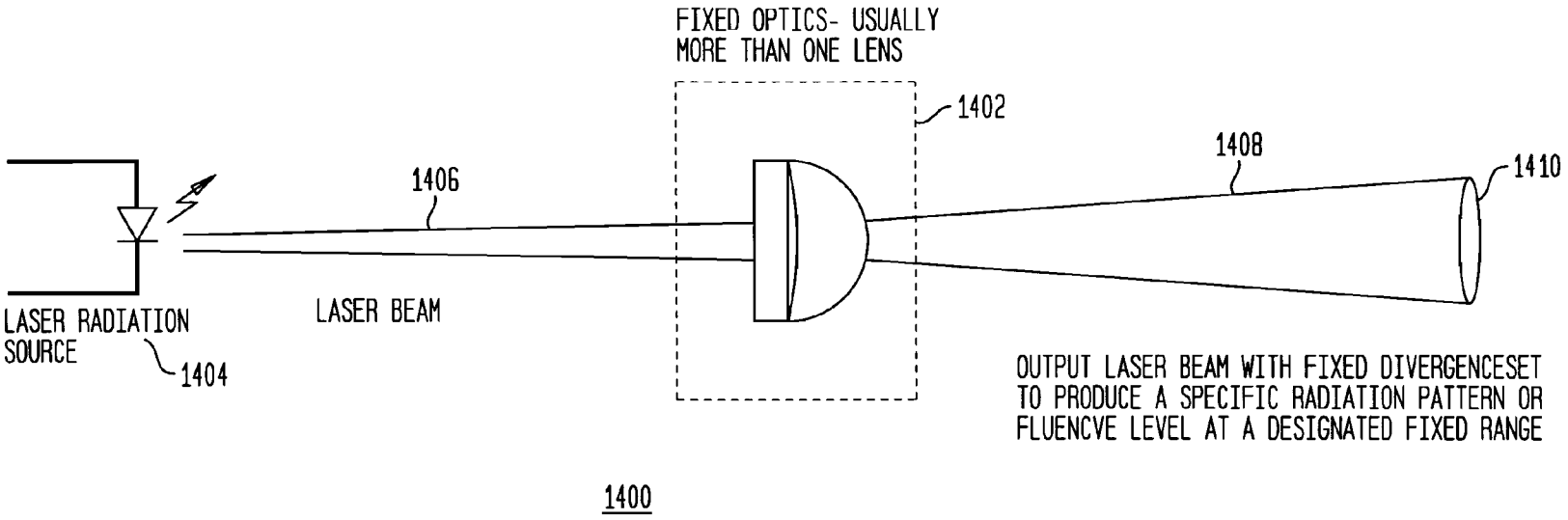
FIG. 14 is a schematic diagram illustrating a typical prior art fixed focus system.

FIG. 14 illustrates a typical fixed focus system 1400 where there is a fixed focus lens assembly 1402 in front of a laser radiation source 1404. The fixed focus lens assembly 1402 is designed to adjust the small divergent laser beam 1406 to a beam having a different divergence 1408, having a specific radiation pattern 1410, also called fluence or fluence level, at a fixed range.

In designing the divergence of the output beam, a designer typically seeks to achieve the longest possible effective dazing range and the shortest possible safe range, which is the shortest range at which the device does not violate the ANSI standard range for safe operation of the laser. Unfortunately, with a fixed focus approach, these two goals cannot be met simultaneously. The designer is forced to compromise between a small divergence which produces unsafe ranges close to the device and a larger divergence to make the device safe close up but which reduces the effectiveness of the device at a longer range. This compromise is illustrated graphically in FIG. 15.

Figure 15:
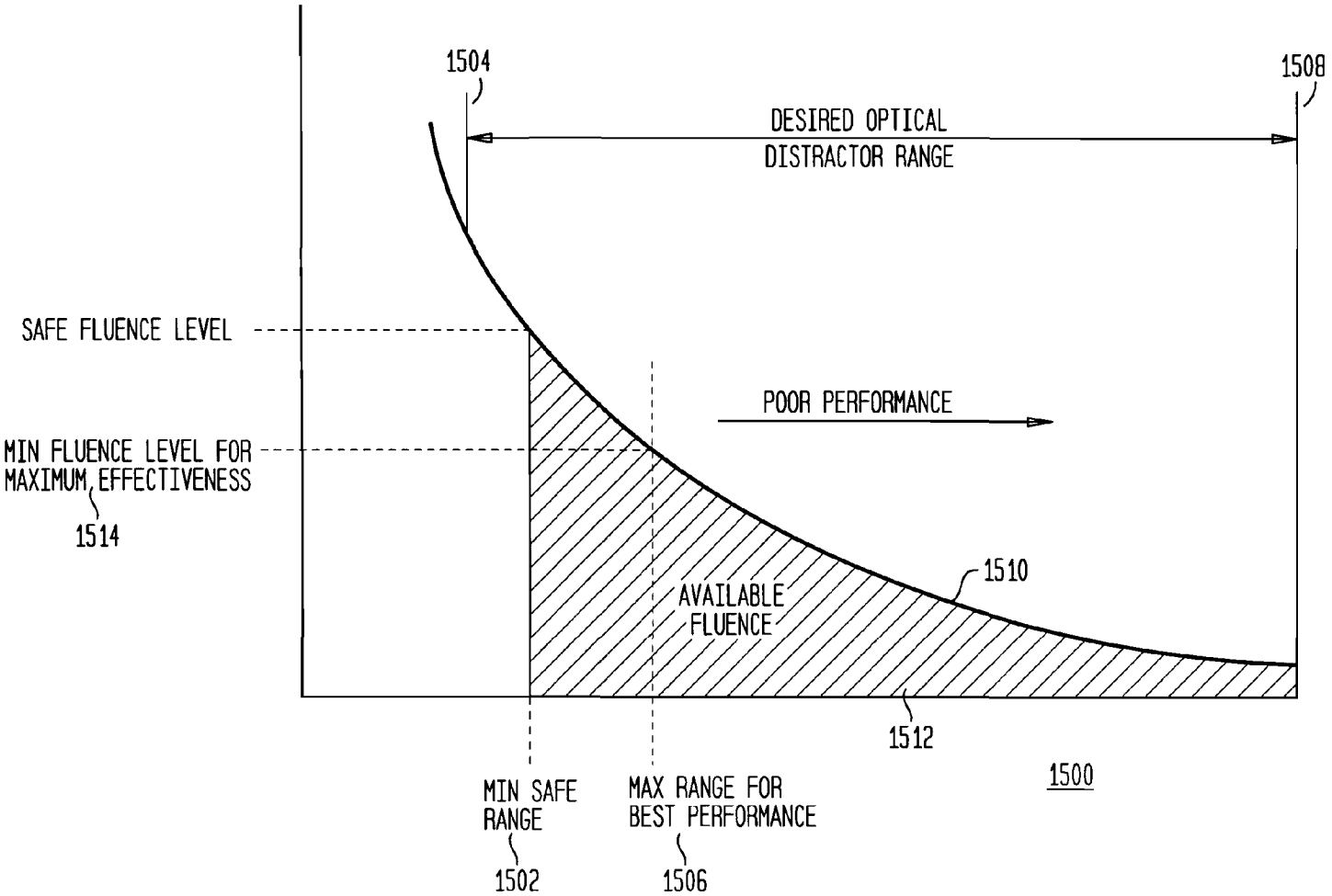
FIG. 15 is a graphical illustration of factors encountered in a system according to FIG. 14.

FIG. 15 illustrates 1500 that a compromise has been made at short range to extend the safe range 1502 beyond the shortest range desired 1504 and a significant compromise has been made at longer ranges due to the diminishing fluence level going from the maximum range for best performance 1506 to the desired maximum system range 1508.

This reduction in dazing performance, illustrated by the curve 1510, is the result of the fact that for a fixed focus system where the laser beam divergence is fixed, laser fluence falls off in proportion to the square root of the inverse range. The area 1512 under the curve 1510 reflects this fall-off in fluence as range increases. Reduced dazing effectiveness results from this design compromise at longer range due to the difference between the minimum fluence level 1514 and the resulting fluence level at any particular longer range.

Figure 16:
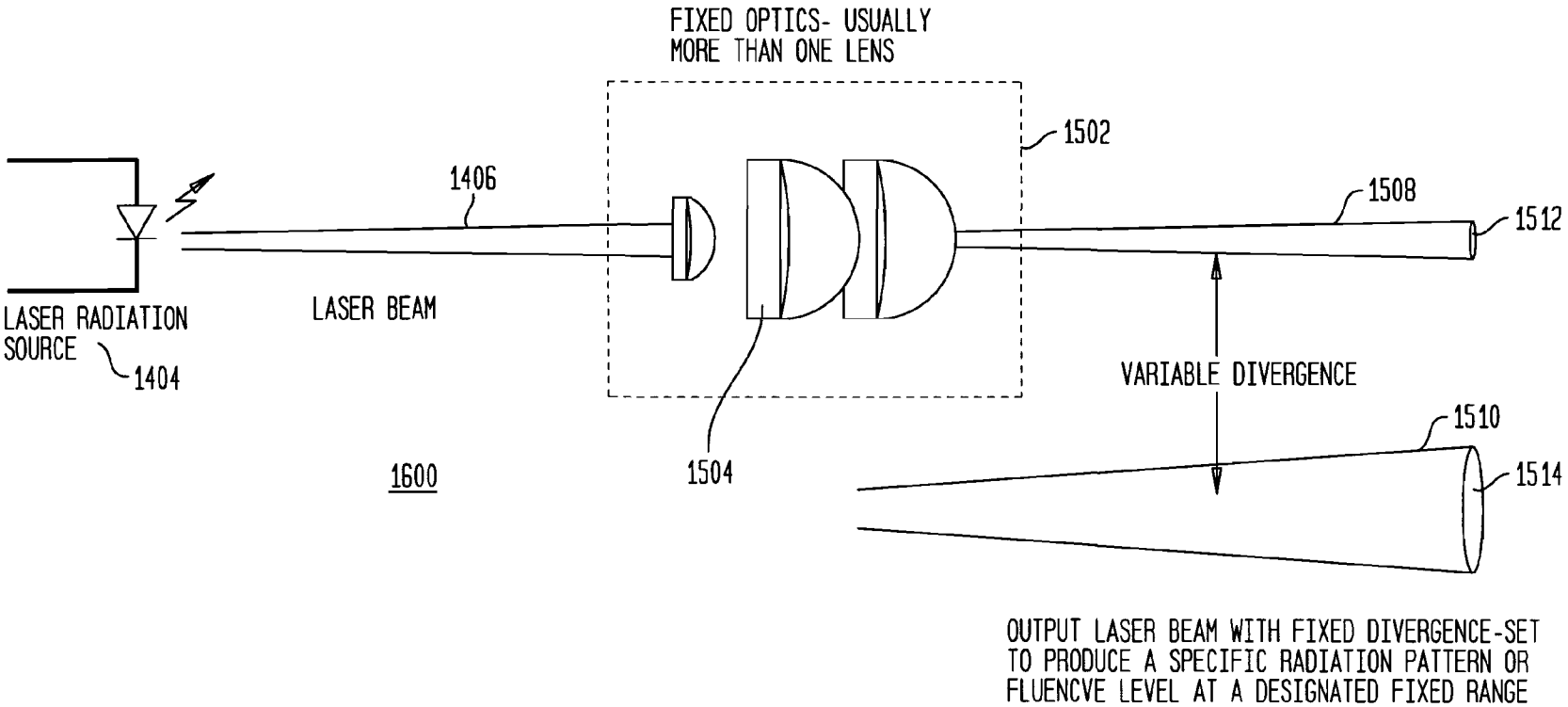
FIG. 16 is a schematic diagram illustrating variable range and focus of a laser dazer, in accordance with an embodiment of the present invention.

The performance of the laser dazer using the inventive variable range and focus system dramatically improves over lasers using a fixed focus approach. FIG. 16 illustrates an exemplary physical implementation 1600 of the variable range and focus system. Like the fixed focus approach illustrated in FIG. 14, the variable focus optics system 1502 adjusts the laser beam 1406 divergence from a laser radiation source 1404. But this is where the similarity ends. The variable focus optics system 1502 allows the output beam divergence 1508, 1510 to vary between two extremes representing far range 1508 and near range 1510, as well as any range in between (not depicted). In this way the laser dazer's performance can be optimized for any threat encounter range within the system range limits. Corresponding useful and optimized fluence levels 1512, 1514 are thereby produced, respectively.

Figure 17:
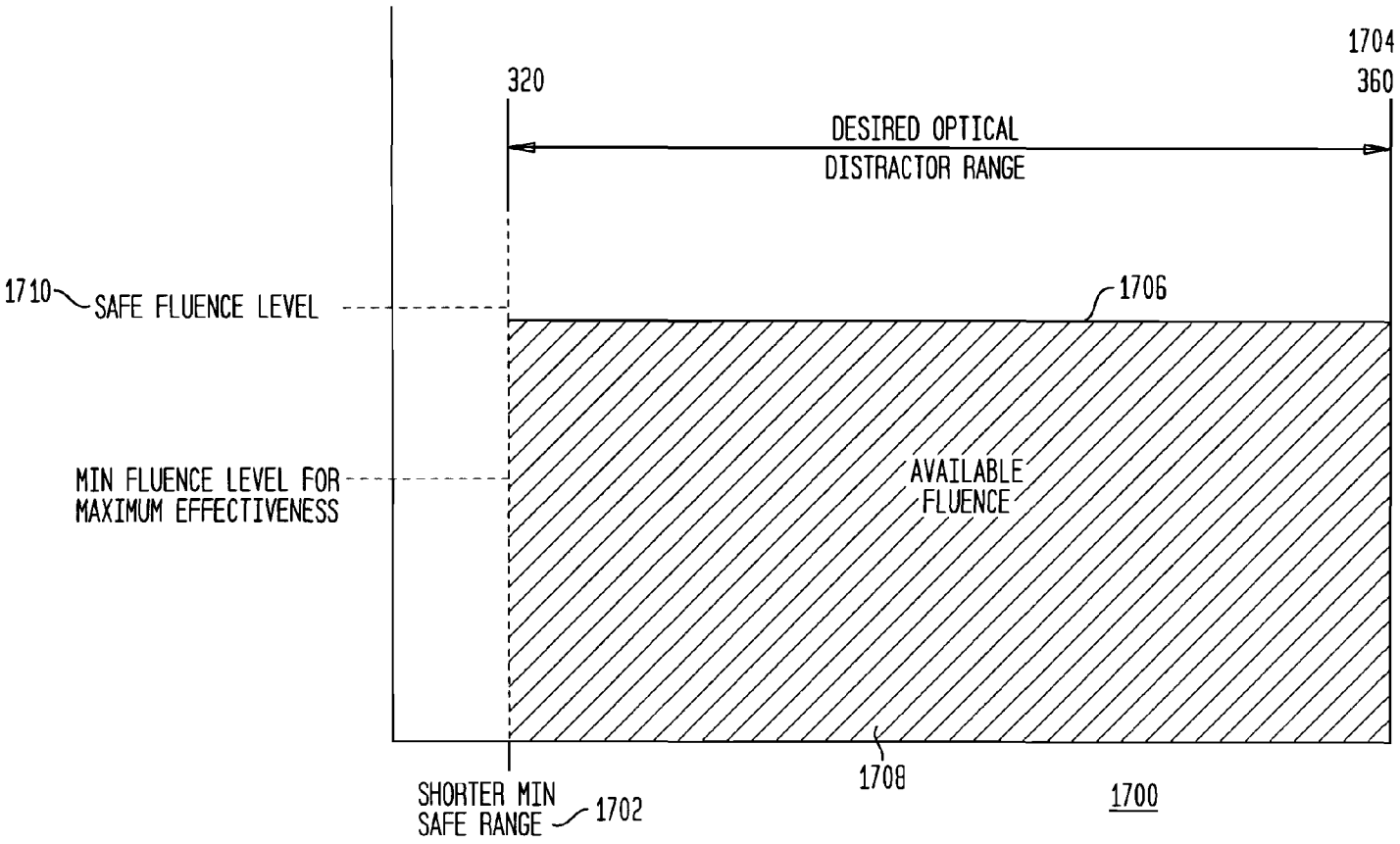
FIG. 17 is a graphical illustration of advantageous factors of a system according to FIG. 16.

FIG. 17 is an illustration 1700 depicting typical system performance improvement. By designing a variable focus system into the laser dazer, several system benefits are realized. The following summarizes some of these benefits. First, the design avoids the compromise as described above for the fixed focus approach. Second, the system minimum safe range 1702 is effectively reduced. Third, maximum dazing performance is available at maximum system range 1704. Fourth, Maximum fluence level 1706 is achieved at any range. The strength of the beam or fluence level directly relates to dazing effectiveness, so focusing permits the user to achieve this condition at any range. Fifth, any fluence level less than maximum is allowed to be adjusted at any range 1708—for example, if the user wishes to warn an aggressor and avoid maximum strength dazing as a first step in an encounter, the user simply adjusts the beam spread to a shorter range. As the encounter continues, the user is free to re-adjust focus to a longer range to increase dazing effectiveness. Sixth, the user is able to adjust the fluence level to compensate for different background lighting conditions. Seventh, ANSI safe fluence level 1710 is assured at any range. Eighth, Collateral exposure and dazing is controlled by adjusting the beam size or fluence at a particular range. Ninth, the user is able to quickly transition from warning to dazing without changing position. Tenth, the user is able to perform effective dazing at longer ranges, thereby reducing engagement risks.

The variable range and focus capability may be implemented on a laser dazer as either a manual adjustment or auto-adjustment. A preferred embodiment of the invention provides an auto-adjustment feature.

As depicted in FIG. 11, the auto-adjustment implementation of variable range and focus—or EFocus—can be schematically represented as a piggyback onto the system schematic of FIG. 10. In addition to the MCU 1002 and other components described in FIG. 10, an additional MCU 1104 is also provided to interface focus position electronics 1106, MCU 1002, and a display 1108. Additional MCU 1108 interrogates the optic position using an algorithm which converts these position readings to target range and safe range numbers, which are then passed to the display 1108. Additional MCU 1108 also passes on to the display status information on battery, temperature, security code and MEAN Beam night/day setting. A preferred embodiment of the invention uses the PIC18F2520 as additional MCU 1108.

The focus driver and electronics 1102 is an electro-mechanical subsystem for changing the position of movable optical components for the purpose of changing the divergence of the laser beam, which effectively changes the target and safe ranges. Micro motors based on the piezo-electric principle and Hall effect sensors are used in a preferred embodiment of the invention to move the optical components.

Focus position electronics 1106 is an electrical subsystem that monitors and reports position of the movable optical components.

The laser beam produced in a preferred embodiment of the invention is referred to herein as a "MEAN" Beam, which is an acronym for "Modulated, Erradically pulsed, Awareness inhibiting, and Nausea inducing."

A MEAN Beam is an inventive approach for generating a radiation waveform from any light emitting device, such as but not limited to a laser diode or LED. This approach combines a pulse width modulated (hereinafter, "PWM") beam with a continuous wave (hereinafter, "CW") beam in such a way as to produce a waveform that varies both temporally and spatially in one or more radiation sources. Additionally, the PWM and CW are made to vary in different ways depending on ambient light conditions. It has been discovered that this type of MEAN Beam waveform enhances the temporary debilitating effect that a radiation beam has on a person's vision and brain, such as experienced in devices specifically designed for this purpose, such as a laser dazer, also known by the military term as "optical distractors."

Note also that an embodiment of the present invention provides for using an LED laser source for search mode and a laser diode for dazing mode.

Figure 12:
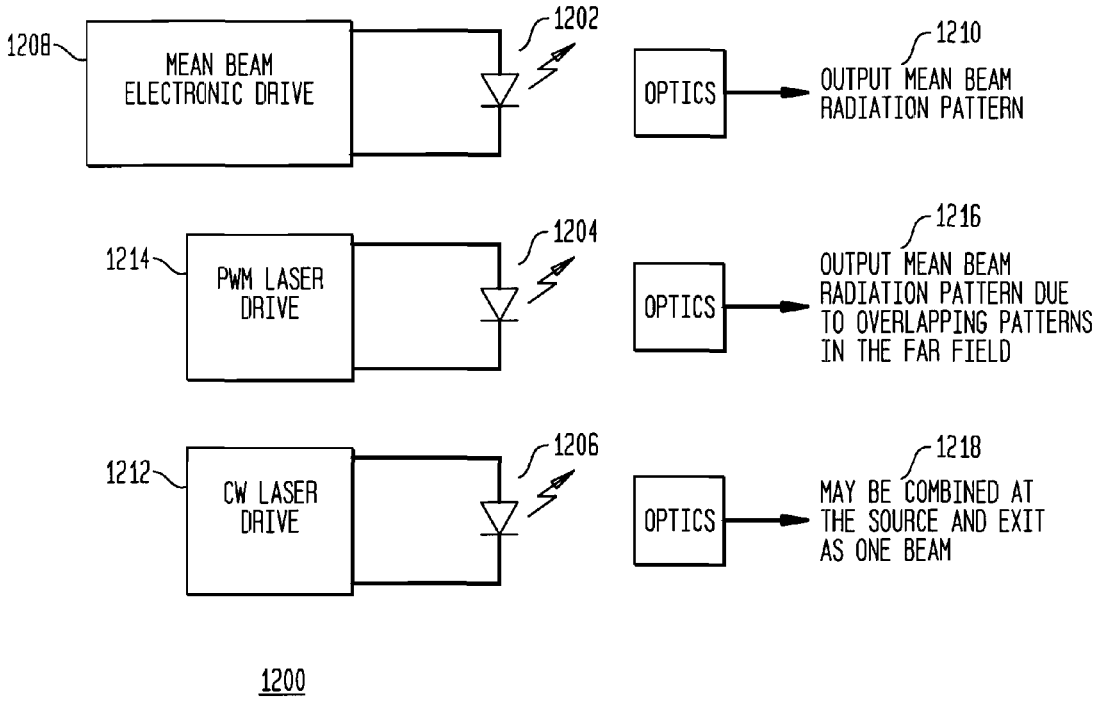
FIG. 12 is a schematic diagram of MEAN Beam generation, in accordance with an embodiment of the present invention.

The fundamental characteristic of a MEAN Beam is the combination of a PWM beam with a CW beam in several different ways as illustrated 1200 in FIG. 12. As illustrated, this may be done by electronically driving one radiation source 1202 with a complex signal 1208 to produce one radiation pattern 1210 which varies both in time and space, or, alternatively, to produce different radiation pattern in two sources 1204, 1206, where each varies only in space 1212 or time 1214, then spatially 1216 or optically 1218 combine the radiation patterns or beams to produce a beam with the MEAN Beam functional characteristic. These basic techniques of applying a single complex drive to one radiation source or separate PWM and CW drives to two radiation sources may be extended to multiple radiation sources in both cases. Although FIG. 12 represents the MEAN Beam laser source as a laser diode, the concept is not limited to this type of source—any other laser source may also be employed.

The MEAN Beam concept also encompasses various other radiation patterns operating sequentially from one or several radiation sources. For example, a MEAN Beam followed by an interval of pure PWM, followed by an interval of pure CW may be used. The following detailed description of a MEAN Beam assumes a single laser diode radiation source, or simply laser, since this is the more complex implementation of the MEAN Beam concept.

Figure 13A:
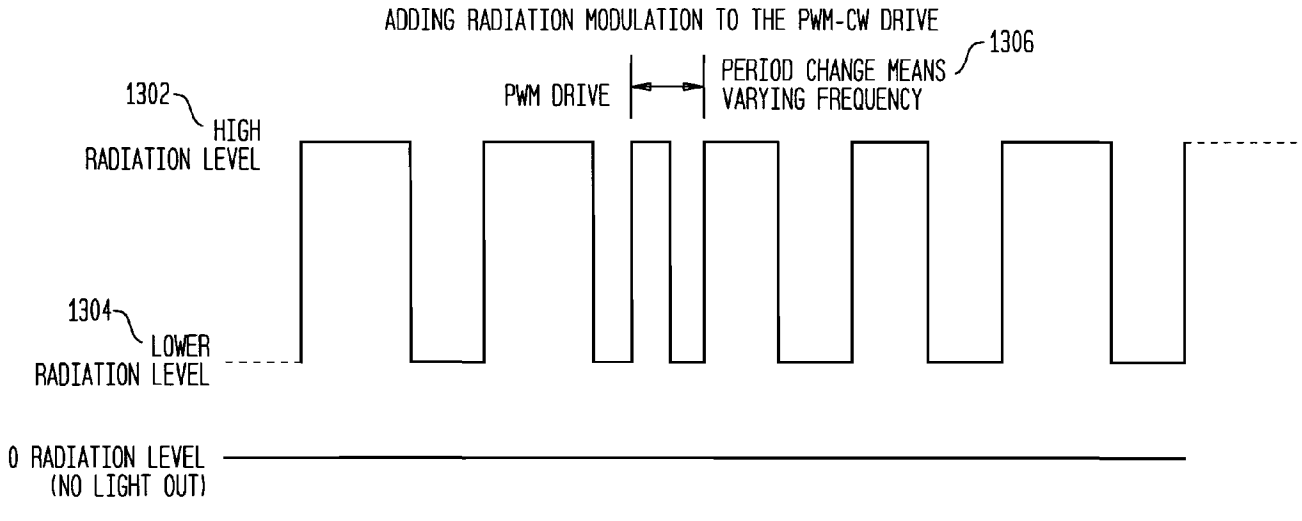
FIG. 13A illustrates generation of a MEAN Beam, in accordance with an embodiment of the present invention.
Figure 13B:
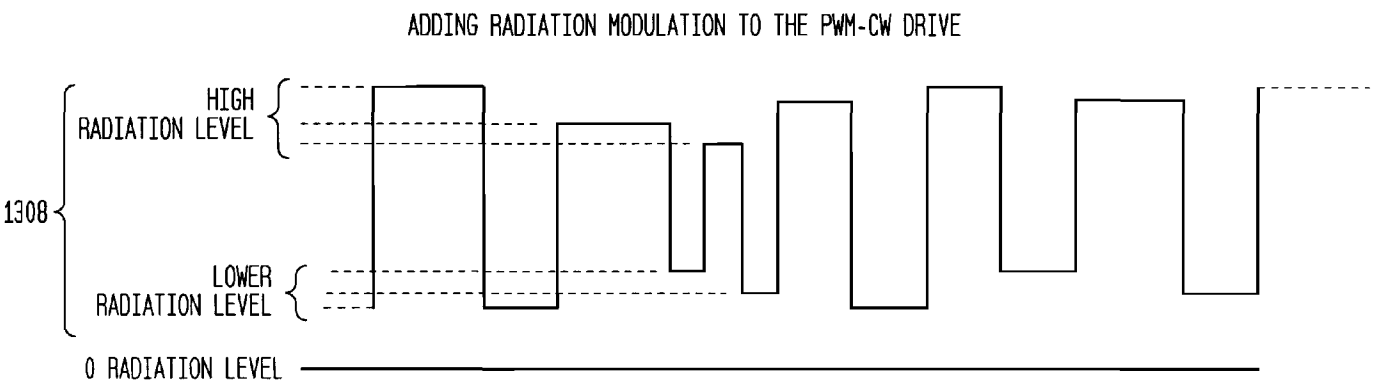
FIG. 13B further illustrates generation of the MEAN Beam as in FIG. 13A.

FIGS. 13A and 13B illustrate MEAN Beam functional characteristics. A MEAN Beam laser operates in neither a constant-on nor a pulsed on and off mode, but rather in an in-between mode where the on portion is characterized by PWM at a high radiation level 1302 and the PWM off half period is characterized by a lower level 1304 of radiation which is not zero. This lower level 1304, occurring during the PWM off interval, as well as the higher level 1302, occurring during the PWM on interval, may be fixed or vary over time. In addition, the PWM frequency may be fixed or may vary over time 1306.

Combining PWM and CW in one laser diode is accomplished by driving the laser to a defined high power level, and then to a defined lower power level, as shown in FIG. 13A. The high 1302 and low 1304 radiation levels may be fixed or may vary over time using any of a number of radiation level modulation schemes. FIG. 13A illustrates the basic concept without radiation level modulation, whereas FIG. 13B illustrates the concept with radiation modulation 1308.

The PWM frequencies 1306 together with the CW modulation 1308 scheme used in an embodiment of the MEAN Beam in the present invention are particularly chosen to enhance the temporary debilitating effect that a radiation beam has on a person's vision and brain in a laser dazer device. This effect may be further enhanced by tailoring the MEAN Beam characteristics as a function of the ambient light conditions. For example, the PWM frequency may be a range of frequencies between F1 Hz and F2 Hz, and the instantaneous frequency may be caused to slew between F1 and F2. While the PWM changes, the CW modulation depth 1308 may be changed to a preferred depth for night operation and to a different depth for day operation. In addition, the two frequency extremes F1 and F2, as well as the slew rate, or time to transition from F1 to F2 and back, may be changed to coincide with day and night operations, or for other physiological reasons. This change in MEAN Beam characteristics based on prevailing light conditions may be automatic or may be by manual adjustment directed by the device user.

The principle of adjusting MEAN Beam operating characteristics based on light conditions may be extended to other physical conditions such as, but not limited to rain, snow and humidity.

The principle of adjusting MEAN Beam operating characteristics based on physical conditions may also be extended to tailoring the parameters to be most effective against a person's eye-brain physiology.

A preferred embodiment of the invention uses a laser with a wavelength in the visible spectrum, having a wavelength from 400-700 nm, most preferably "green" with a wavelength of approximately 532 nm. The daytime preferred MEAN Beam is 10-30% PWM, most preferably 20% PWM, with the remainder CW, and 5-20 Hz PWM, most preferable 6-15 Hz PWM. The nighttime preferred MEAN Beam is 30-70% CW, most preferably 60% CW, with the remainder PWM, and 5-20 Hz PWM, most preferable 6-15 Hz PWM.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A laser dazing apparatus comprising:

an elongated barrel encasement having a forward end and a rear end, connected to a handle encasement towards the barrel's rear end, the handle encasement having a major axis aligned approximately perpendicular to a major axis of the barrel encasement;

the barrel encasement further comprising an adapter ring at the forward end, and a focusing fixture for controlling divergence of radiation produced by the apparatus, the adapter ring providing a laser aperture and controlling the focusing fixture;

the barrel encasement further comprising a control panel, the control panel comprising a plurality of indicators and a plurality of switches;

wherein said laser generator comprises a single radiation source to generate both a pulse width modulated (PWM) and continuous wave (CW) laser beam and the switches comprise at least one switch for selecting between the laser generating a PWM and a CW laser beam, or both;

the barrel encasement and handle encasement together providing an enclosure for a laser generator, a least one battery for electrical power, and a plurality of control circuits in communication with the laser generator, battery, indicators and switches;

the apparatus further comprising a trigger, the trigger in communication with the control circuits;

the barrel encasement further comprising one or more focus range adjuster, the focus range adjuster in communication with the control circuits;

wherein the trigger causes the control circuits to control the laser generator to generate electromagnetic output.

2. The laser dazing apparatus according to claim 1, further comprising a mating device at an end of the handle encasement furthest from the barrel encasement for mourning the apparatus on a tripod.

3. The laser dazing apparatus according to claim 1, wherein the switch for selecting between the PWM and CW modes further provides for selection of an intermediate mixture of PWM and CW modes.

4. The laser dazing apparatus according to claim 3, wherein the switch for selecting between the PWM and CW modes further provides for selection of a radiation modulation mode in which output radiation varies in time and intensity between one or more high levels and one or more low levels.

5. The laser dazing apparatus according to claim 4, wherein the at least one battery is rechargeable.

6. The laser dazing apparatus according to claim 5, wherein the laser generating device comprises more than one laser diode.

7. The laser dazing apparatus according to claim 6, wherein the wavelength of radiation output by each laser diode varies.

8. The laser dazing apparatus according to claim 7, wherein the switches further comprises a switch for toggling between a laser search mode and a dazing mode.

9. The laser dazing apparatus according to claim 8, wherein the amplitude and PWM of each laser diode in dazing mode may be the same or different, and may be time variable.

10. The laser dazing apparatus according to claim 9, further comprising a switch for enabling an instant dazing mode, and a switch for activating dazing, wherein during use of the apparatus, selection of instant dazing mode enables the dazing mode activation switch to immediately activate dazing.

11. The laser dazing apparatus according to claim 10, the barrel further comprising a plurality of fins to act as heat sinks for the laser generation device.

12. The laser dazing apparatus according to claim 10, the barrel further comprising electronic component heat transfer through the control panel, wherein the control panel acts as an external heat sink.

13. The laser dazing apparatus according to claim 10, wherein the focusing fixture provides for the output radiation to be continuously focused from 1 meter to 2400 meters with a preferred radiation fluence size.

14. The laser dazing apparatus according to claim 13, where the focusing fixture further comprises a step motor for step-wise automatic focusing.

15. The laser dazing apparatus according to claim 14, where the focusing fixture further comprises a Hall-effect sensor for improved focusing control.

16. The laser dazing apparatus according to claim 15, further comprising an optical fiber attachment which, when affixed to the forward end of the elongated barrel, allows the device to be used around corners.

17. The laser dazing apparatus according to claim 16, wherein the optical fiber attachment is affixed to the adapter ring.

18. The laser dazing apparatus according to claim 15, wherein the control panel further comprising a plurality of keys, whereby, in operation, the apparatus enters a sleep mode after a predetermined period of time without use and the device will not further operate until the plurality of keys are pressed in a predetermined sequence.

19. The laser dazing apparatus according to claim 4, wherein the at least one battery is non-rechargeable.

* * * * *